US011964682B1

(12) United States Patent
Dunn et al.

(10) Patent No.: US 11,964,682 B1
(45) Date of Patent: Apr. 23, 2024

(54) RAIL CONTROL SYSTEM AND/OR METHOD

(71) Applicant: Parallel Systems, Inc., Los Angeles, CA (US)

(72) Inventors: Patrick Dunn, Los Angeles, CA (US); Andrea Anez, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

(21) Appl. No.: 18/499,034

(22) Filed: Oct. 31, 2023

Related U.S. Application Data

(60) Provisional application No. 63/421,058, filed on Oct. 31, 2022.

(51) Int. Cl.
*B61L 27/50* (2022.01)
*B61L 25/02* (2006.01)
*B61L 27/04* (2006.01)

(52) U.S. Cl.
CPC ..... *B61L 27/04* (2013.01); *B61L 25/025* (2013.01); *B61L 27/50* (2022.01); *B61L 2205/04* (2013.01)

(58) Field of Classification Search
CPC ..... B61L 27/04; B61L 27/50; B61L 25/025; B61L 2205/04
See application file for complete search history.

(56) References Cited

U.S. PATENT DOCUMENTS

| | | | |
|---|---|---|---|
| 11,305,796 | B1 | 4/2022 | Shue et al. |
| 2004/0006413 | A1 | 1/2004 | Kane et al. |
| 2009/0184211 | A1 | 7/2009 | Groves et al. |
| 2012/0203419 | A1 | 8/2012 | Tucker et al. |
| 2017/0320507 | A1 | 11/2017 | Denny et al. |
| 2018/0231972 | A1 | 8/2018 | Woon et al. |
| 2018/0339719 | A1 | 11/2018 | Loughlin |
| 2019/0176862 | A1 | 6/2019 | Kumar et al. |
| 2019/0389498 | A1 | 12/2019 | Grimm et al. |
| 2021/0291883 | A1 | 9/2021 | Gotlund et al. |
| 2022/0137623 | A1 | 5/2022 | Goyal et al. |
| 2022/0185350 | A1 | 6/2022 | Kindt et al. |

FOREIGN PATENT DOCUMENTS

| | | | |
|---|---|---|---|
| WO | 2017211593 | A1 | 12/2017 |
| WO | 2022192795 | A2 | 9/2022 |

OTHER PUBLICATIONS

Dunn, Patrick , et al., "System and/or Method for Remote Operation of a Rail Vehicle", U.S. Appl. No. 18/514,946, filed Nov. 20, 2023.
Dunn, Patrick , et al., "Rail Authority System and/or Method", U.S. Appl. No. 18/373,225, filed Sep. 26, 2023.

*Primary Examiner* — Mathew Franklin Gordon
(74) *Attorney, Agent, or Firm* — Jeffrey Schox; Diana Lin

(57) ABSTRACT

The system 100 can include: a fleet management system, a motion planner, a vehicle controller, and a track data system. The system can optionally include a user interface. However, the system 100 can additionally or alternatively include any other suitable set of components. The system functions to facilitate waypoint-based command, navigation, and/or control of rail vehicles within a rail network. Additionally or alternatively, the system can function to facilitate execution of the method S100 and/or sub-elements thereof.

20 Claims, 9 Drawing Sheets

RAIL CONTROL SYSTEM AND/OR METHOD

CROSS REFERENCE TO RELATED APPLICATIONS

This application claims the benefit of U.S. Provisional Application No. 63/421,058, filed 31 Oct. 2022, which is incorporated herein in its entirety by this reference.

This application is related to U.S. application Ser. No. 18/373,225, filed 26 Sep. 2023, which is incorporated herein in its entirety by this reference.

TECHNICAL FIELD

This invention relates generally to the transportation field, and more specifically to a new and useful rail navigation system and/or method in the transportation field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview

Figure 1:
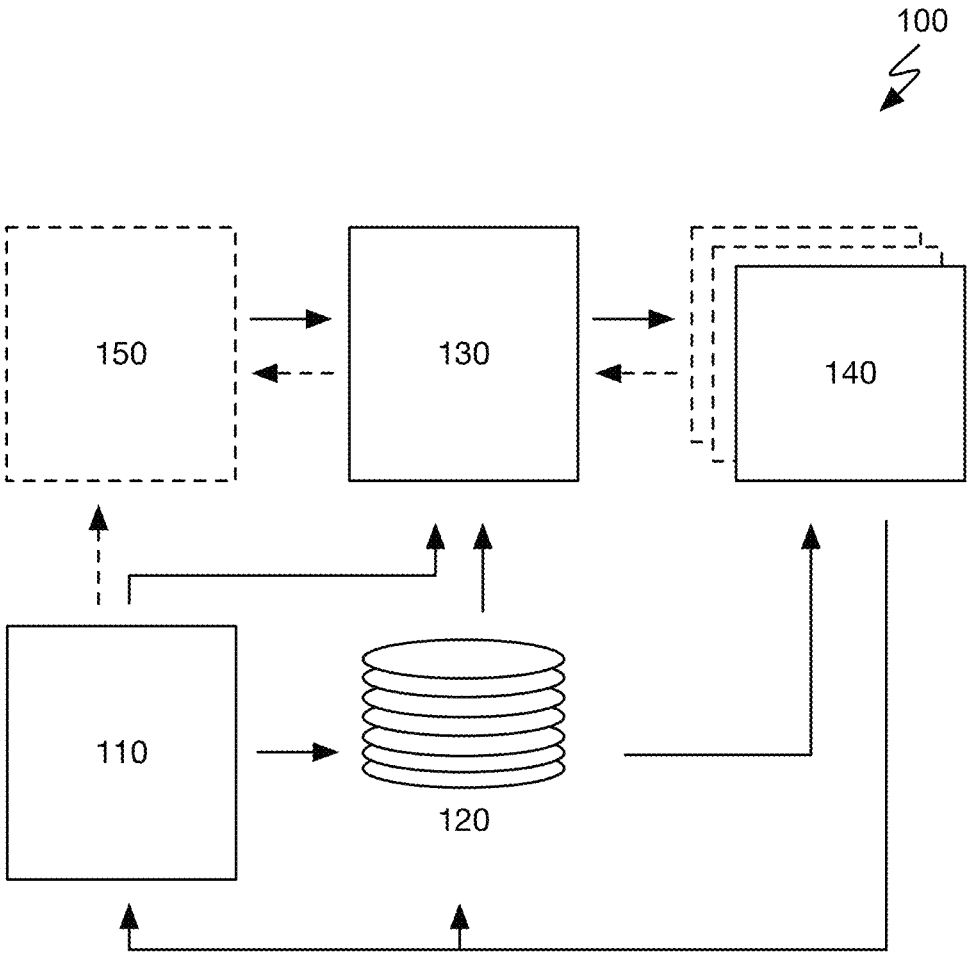
FIG. 1 is a schematic representation of a variant of the system.
Figure 3:
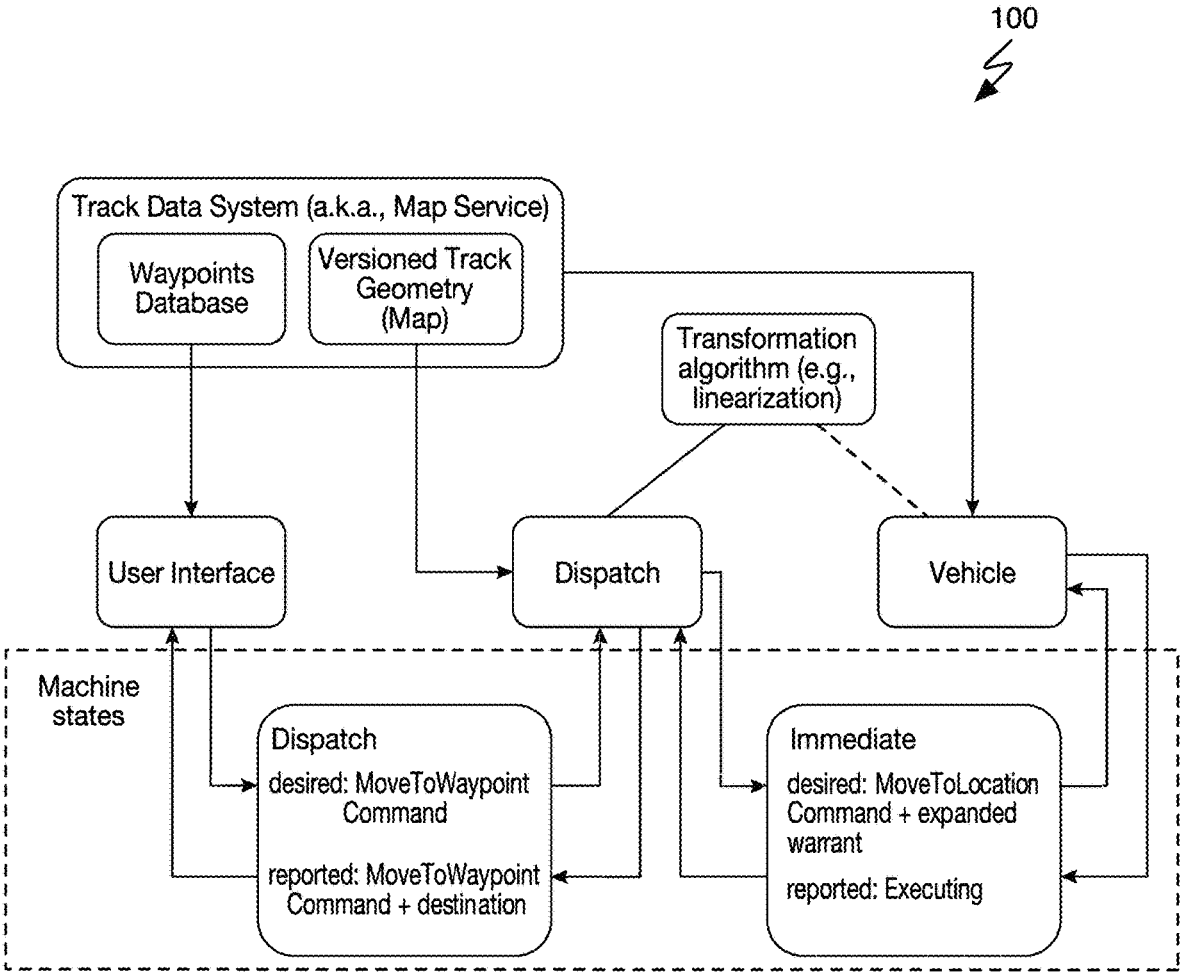
FIG. 3 is an example flowchart schematic of a variant of the system and/or method.

The system 100, an example of which is shown in FIG. 1, can include: a user interface 110, a track data system 120, a motion planner 130, and a vehicle controller 140. The system can optionally include or be used with a fleet management system 150. However, the system 100 can additionally or alternatively include any other suitable set of components. The system functions to facilitate waypoint-based command, navigation, and/or control of rail vehicles within a rail network. Additionally or alternatively, the system can function to facilitate execution of the method S100 and/or sub-elements thereof. An example of the system 100 is shown in FIG. 3.

The method S100 can include: determining a navigation command Silo; dispatching a vehicle based on the navigation command S120; and controlling the dispatched vehicle based on the command S130. The method functions to facilitate waypoint-based operation of rail vehicles within a rail network.

Variants of the system can utilize waypoints to identify locations of interest through Earth-referenced coordinates (e.g., overlayed on a satellite image based and/or GPS-based track map, for example), such as GPS coordinates, which can be "linearized" or otherwise transformed into a specific piece of track. Waypoints can be independent of any map version or map instance (e.g., as being inherently 'global' in an Earth coordinate frame) and may reliably pinpoint track features in an inherent physical location, even more ephemeral track geometry abstractions change (i.e., where elements are added, removed, reindexed, change in dimension, etc.). The term "track geometries" may be used herein to refer to data structure abstractions of physical "track features" (e.g., elements/objects which are extant and/or observable in the real world) and/or may be otherwise used.

Figure 7:
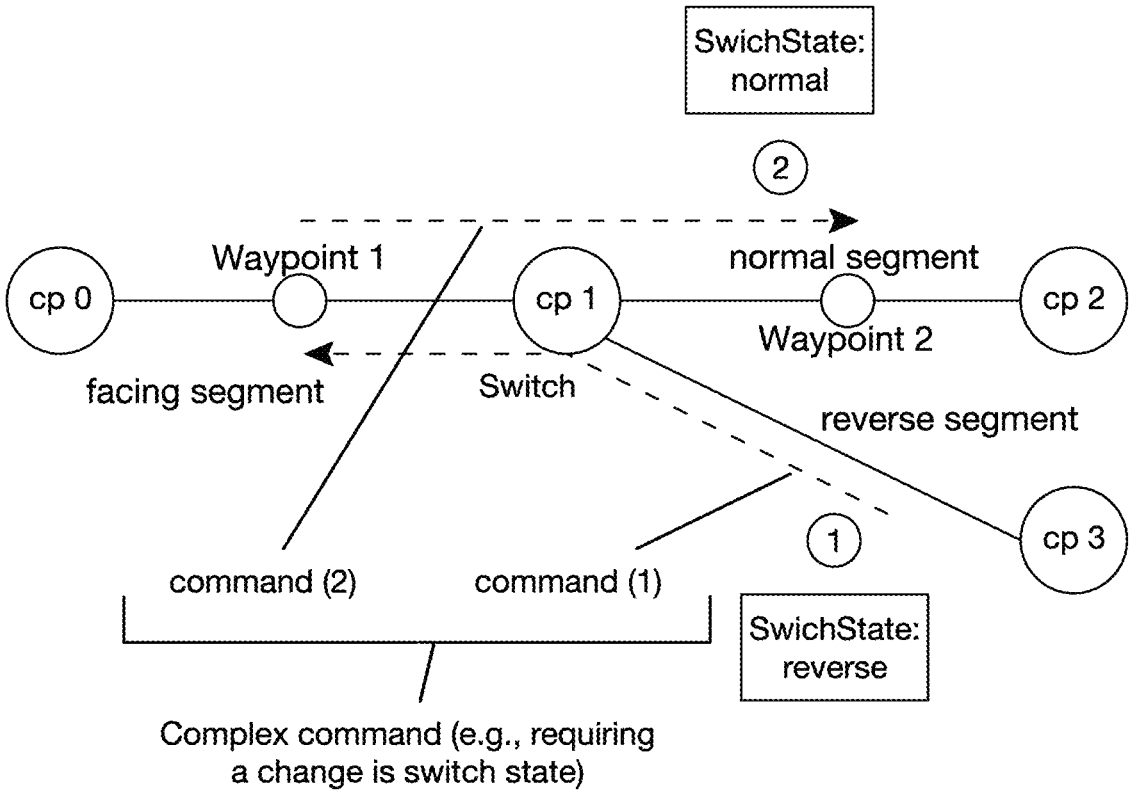
FIG. 7 is an example diagram illustrating complex rail routing via waypoint-based navigation.

Variants can additionally utilize waypoints to stack simpler actions to form a more complex routing maneuver (e.g., as a series/sequence of waypoint-based actions), which may significantly reduce algorithmic complexity and enable complex routing to be executed by higher-order algorithms that can abstract simple routes created by low-level algorithms. For example, when routing through switches, a complex route can be generated using a sequence of simple waypoint-based routes (e.g., an example is shown in FIG. 7). The route can be successfully completed/executed based on the waypoint command(s) independently of the current map version being used and/or while respecting switch state variance.

In an example workflow, a user chooses a (waypoint) destination and commands the vehicle to it via the user interface. The user interface requests and/or receives the waypoint coordinate information from a waypoints database (e.g., managed by the track data system and/or a map service thereof). The user interface then provides the waypoint and its GPS information in the form of a navigation command to the motion planner. The motion planner can translate the waypoint to a location on the versioned track geometry (e.g., in accordance with Block S120); the location and/or vehicle command associated therewith can then be passed on to the vehicle to facilitate vehicle navigation/control relative to the same versioned track geometry (e.g., in Block S130).

The term "substantially" as utilized herein can mean: exactly, approximately, within a predetermined threshold or tolerance, and/or have any other suitable meaning.

In variants, the term "dispatch" (and/or dispatcher) can be utilized in reference to one or more of: train dispatch (e.g., by a train dispatcher, rail traffic controller, train controller, train service controller, signaller, etc.), motion planning, vehicle command, vehicle instruction, and/or any other suitable element(s) which may be used to facilitate movement of a rail vehicle through a railway network. For example, the term "dispatcher" can refer to the motion planner and/or methods as described in U.S. application Ser. No. 18/373,225, filed 26 Sep. 2023, which is incorporated herein in its entirety by this reference. However, the terms dispatch, dispatcher, and/or dispatching system can be otherwise suitably used/referenced herein.

The system can optionally include or be used in conjunction with a vehicle(s) which traverse within a rail network according to the motion plan and/or commands associated therewith. Each vehicles can include a vehicle controller 140 and/or any other suitable elements. However, the vehicle can include any other suitable elements and/or can be otherwise configured. Additionally or alternatively, the system can be configured to facilitate (waypoint-based) operation and/or routing of a remote vehicle and/or can be used with any other suitable vehicle(s).

In variants, the vehicle(s) can be as described in one or more of: U.S. application Ser. No. 17/694,499, filed 14 Mar. 2022, titled "ELECTRIC RAIL VEHICLE," U.S. application Ser. No. 17/335,732, filed 1 Jun. 2021, titled "ELECTRIC RAIL VEHICLE," each of which is incorporated herein in its entirety by this reference. In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

1.1 Illustrative Examples

In a first set of variants, a method for waypoint-based rail navigation can include: determining a waypoint-based (navigation) command comprising a set of instructions associated with traversal to a destination, the destination including a GPS location of a predetermined feature of a rail network selected, at a user interface, from an aerial image overlay of the rail network; determining an updated track geometry version including a version identifier and a set of nodes and edges, each node indexed in association with a GPS location, each edge extending between a pair of nodes; storing the updated track geometry version at a memory onboard the rail vehicle; at a centralized motion planner, commanding the rail vehicle in track-geometry-referenced coordinates, including: transforming the destination into a track-geometry-referenced position including a linearized distance along an indexed track edge of the track geometry; and autonomously controlling the rail vehicle based on the track-geometry-referenced coordinates, including: at the rail vehicle, validating that the track-geometry-referenced coordinates are associated with the version identifier of the updated track geometry version; and controlling the vehicle on based on the track-geometry-referenced position.

Figure 9:
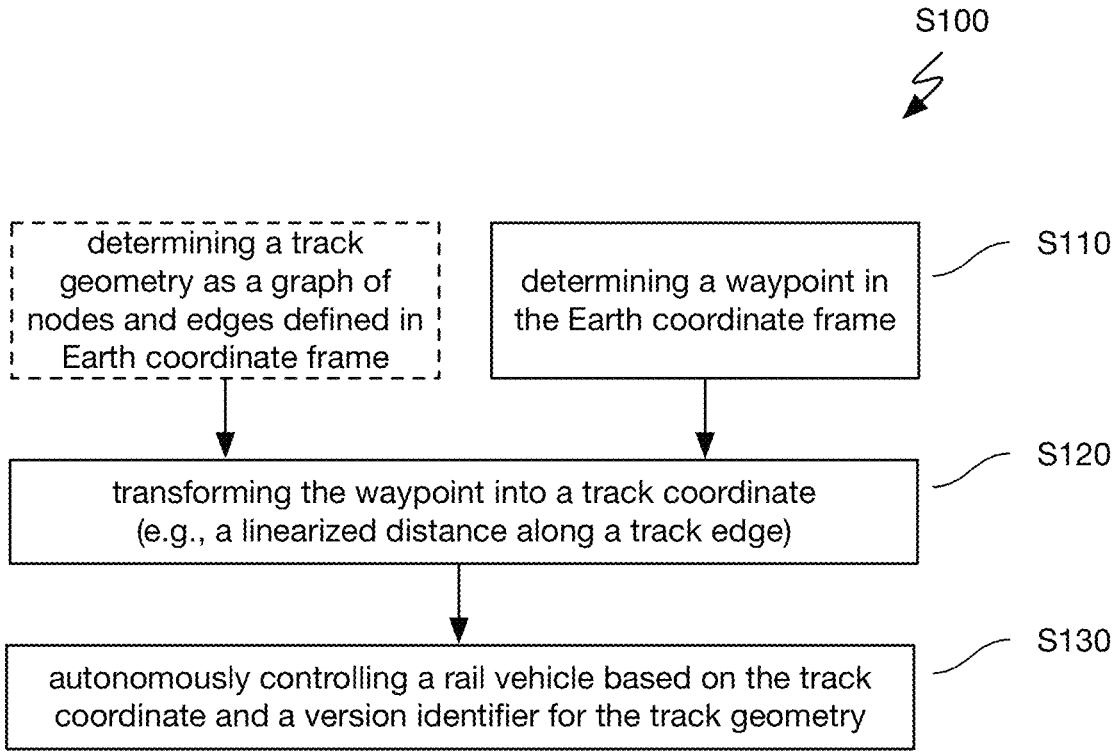
FIG. 9 is an example flowchart diagram of a variant of the method.

In a second set of variants (e.g., an example is shown in FIG. 9), nonexclusive with the first, a method for waypoint-based rail navigation includes: determining a track geometry for a region of a rail network; determining a set of waypoint-based commands in an Earth coordinate frame, wherein the set of waypoint-based commands are independent of the track geometry, wherein the set of waypoint-based commands are associated with navigation to a destination; and controlling the rail vehicle according to the set of waypoint-based commands, including: transforming the destination into a track-geometry-referenced position comprising a linearized distance along an indexed track edge of the track geometry.

Figure 10:
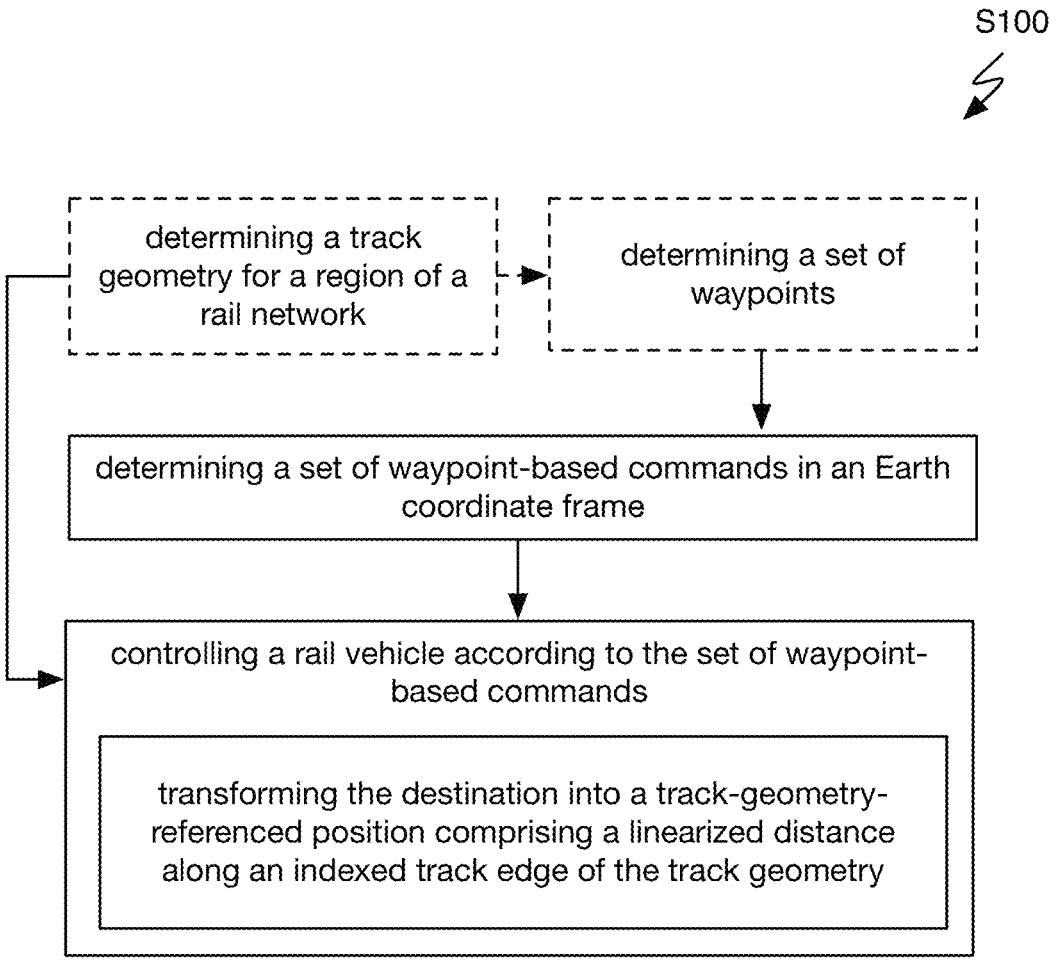
FIG. 10 is an example flowchart diagram of a variant of the method.

In a third set of variants (e.g., an example is shown in FIG. 10), nonexclusive with the first and second sets, a method for waypoint-based rail navigation includes: determining a track geometry comprising a set of indexed track nodes and indexed track edges, the track geometry associated with a version identifier, each indexed track node and track edge defined in an Earth coordinate frame; determining a waypoint in the Earth coordinate frame; transforming the waypoint into a track coordinate comprising a linearized distance along an indexed track edge of the track geometry; and autonomously controlling a rail vehicle based on the track coordinate and the version identifier.

2. Benefits

Variations of the technology can afford several benefits and/or advantages.

Figure 8:
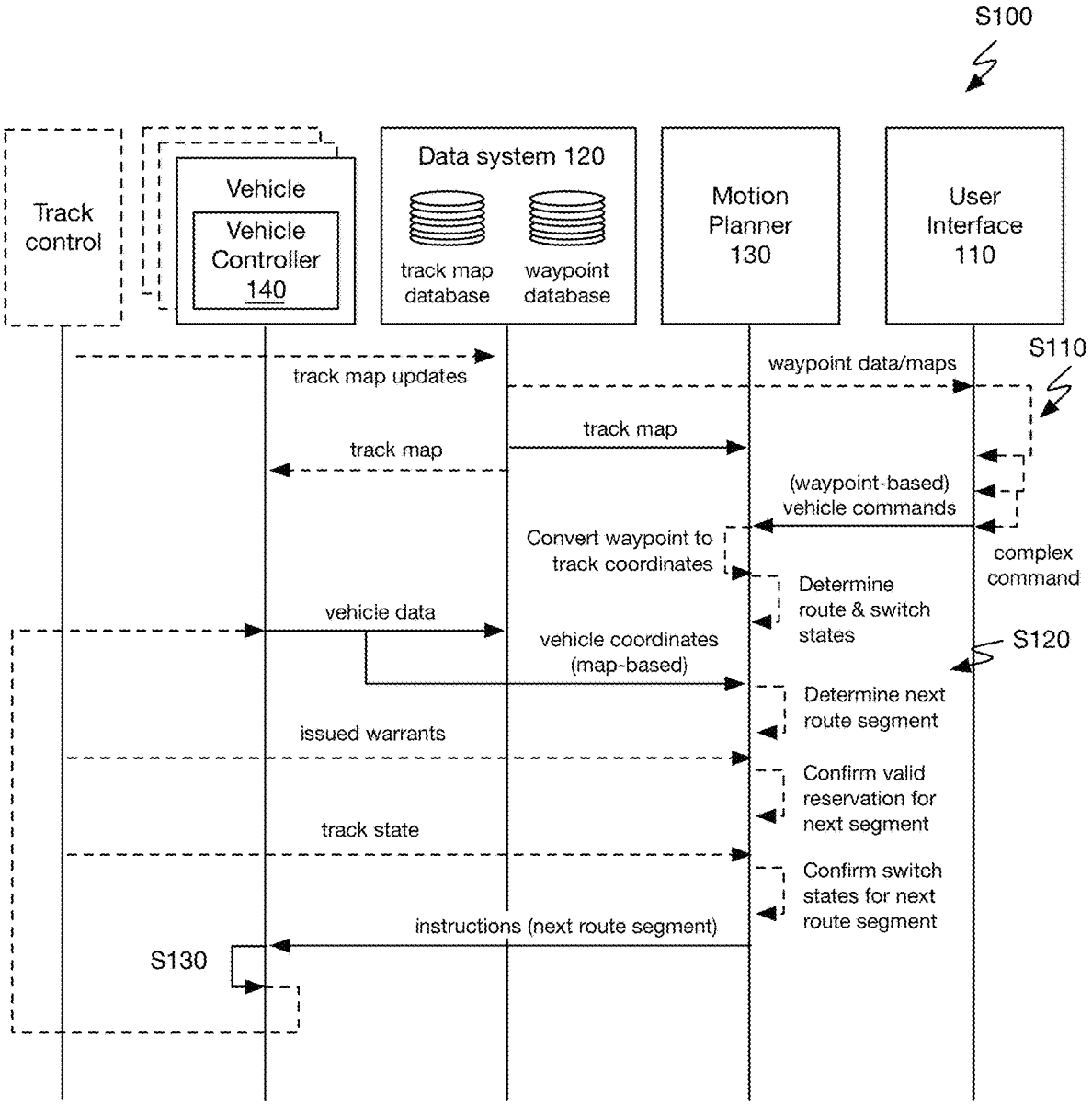
FIG. 8 is a flowchart diagram of a variant of the system and/or method.

First, variations of this technology can facilitate robust, generalizable navigation for railway vehicles under varying track conditions/configurations. For example, hard-coded track-segment-based (or location-based) rail maps and instructions may be rendered obsolete when tracks are reconfigured, which commonly occurs in rail yard environments, or when track conditions change. Instead of relying on specific track segment identifiers or locations along a rail line, variants can utilize abstract (waypoint-based) navigation commands, which can be mapped onto the most-updated/instantaneous rail map(s) to facilitate navigation which respects various configuration(s) of the network (even in cases where there are changes to the relevant segment identifiers, nodes, switch states, track geometry, etc.; deterministically for a particular map version; non-deterministically/dynamically for different map versions; an example is shown in FIG. 8).

Second, variations of the technology can facilitate complex routing/re-routing, even under varying track conditions/configurations, by using waypoint-based navigation instead of hard-coded track segments (e.g., and track segment identifiers). An example of a complex waypoint-based route is shown in FIG. 7 (e.g., which respects/necessitates multiple states of a single switch).

Third, variations of the technology can facilitate tractable human-machine interactions, allowing users to convey instructions in a human interpretable format (e.g., using waypoints or high-level directives; waypoints on aerial image map overlays, etc.) and/or GPS-relative format. Additionally, manually provided, waypoint-based instructions may persist even after one or more changes to the intervening track geometry and/or track map version. As an example, a manually-defined rail route may be stored entirely independently of a transitory map geometry (e.g., at the vehicle and/or motion planner). As a second example, users may select track features (and/or automatically generated waypoints associated therewith) as destinations to facilitate high-accuracy manual routing/navigation around (pre-) mapped track features, without a user needing to directly provide a specific coordinate position[s] (e.g., relative to the track or Earth coordinate frame). Instead, the user may accurately control the vehicle based on the semantic names or tags of route features, which may simplify the human-machine interaction.

Fourth, variations of this technology can facilitate control of (autonomous) rail vehicles under a variety of railroad authority-granting schemes, authority protocols, map notation/reference schemes, and/or other instance-specific information by providing navigational commands and/or vehicle instructions in a generalized form (e.g., waypoints). For example, the technology can enable compatibility with conventional train control systems (e.g., PTC), which grant track authority using track features (e.g., track warrants grant authority to use the track between two named track points, such as switches, clearance points, signals, etc.), by translating generalized waypoints into track coordinates relative to said track features. As an example, variants can facilitate waypoint-based operation in conjunction with the PTC control system(s) and/or method(s) as described in U.S.

application Ser. No. 18/373,225, filed 26 Sep. 2023, which is incorporated herein in its entirety by this reference.

Fifth, variations of this technology can reduce a risk of accidental collisions between autonomous vehicles in a rail network, by constraining dispatched vehicles to operate within separate (non-overlapping) warrants, referenced against a common version of the track geometry map (e.g., even in cases where routes and/or waypoint-based commands for various vehicles may overlap).

However, variations of the technology can additionally or alternately provide any other suitable benefits and/or advantages.

3. System

The system 100, an example of which is shown in FIG. 1, can include: a user interface 110, a track data system 120, a motion planner 130, and a vehicle controller 140. The system can optionally include or be used with a fleet management system 150. However, the system 100 can additionally or alternatively include any other suitable set of components. The system functions to facilitate waypoint-based command, navigation, and/or control of rail vehicles within a rail network. Additionally or alternatively, the system can function to facilitate execution of the method S100 and/or sub-elements thereof.

The user interface [UI] functions to facilitate manual command of vehicles (e.g., in a yard operations context). Additionally or alternatively, the user interface can function to facilitate tele-operation (e.g., in a restricted speed context), manual updates to track map data (e.g., manual determinations of switch state for unmonitored switches, etc.), manual exception handling, and/or other manual interventions/inputs. Additionally or alternatively, the user interface can function to facilitate determination of (navigational) commands in accordance with Block Silo. The user interface can be communicatively connected to a fleet management system and/or a motion planner system to provide manual navigation commands for vehicle command/dispatch and/or control. Additionally, user inputs via the user interface can be used to update the track data (e.g., based on manual bulletin inputs, manual switch state inputs, etc.; within the track data system and/or a map service thereof).

Figure 6A:
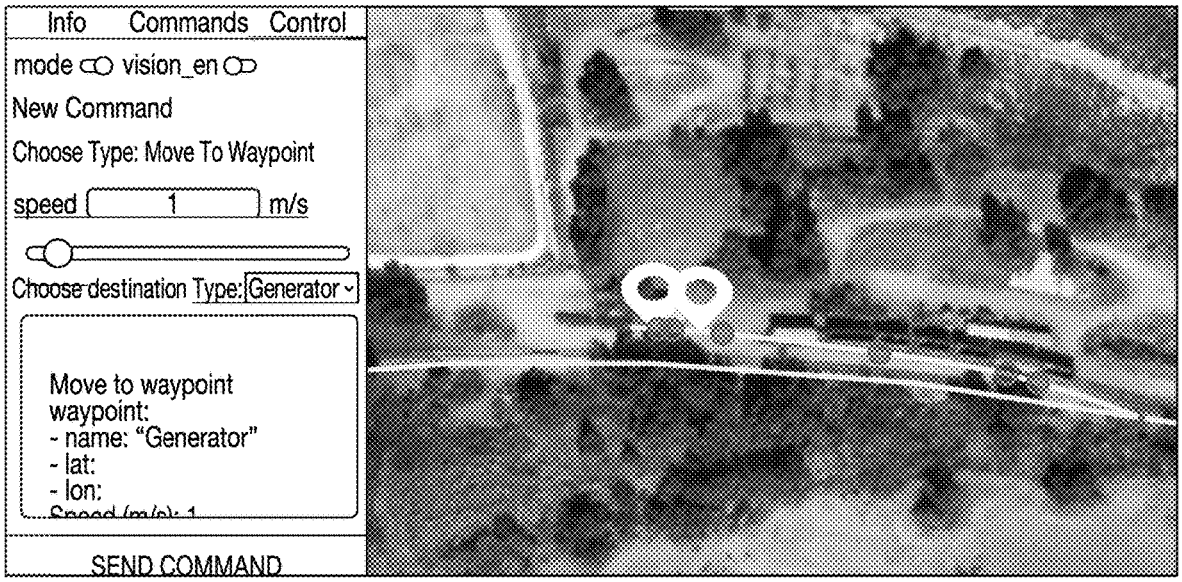
FIGS. 6A-6B are a first and second illustration of a graphical interface facilitating waypoint-based command and/or control.
Figure 6B:
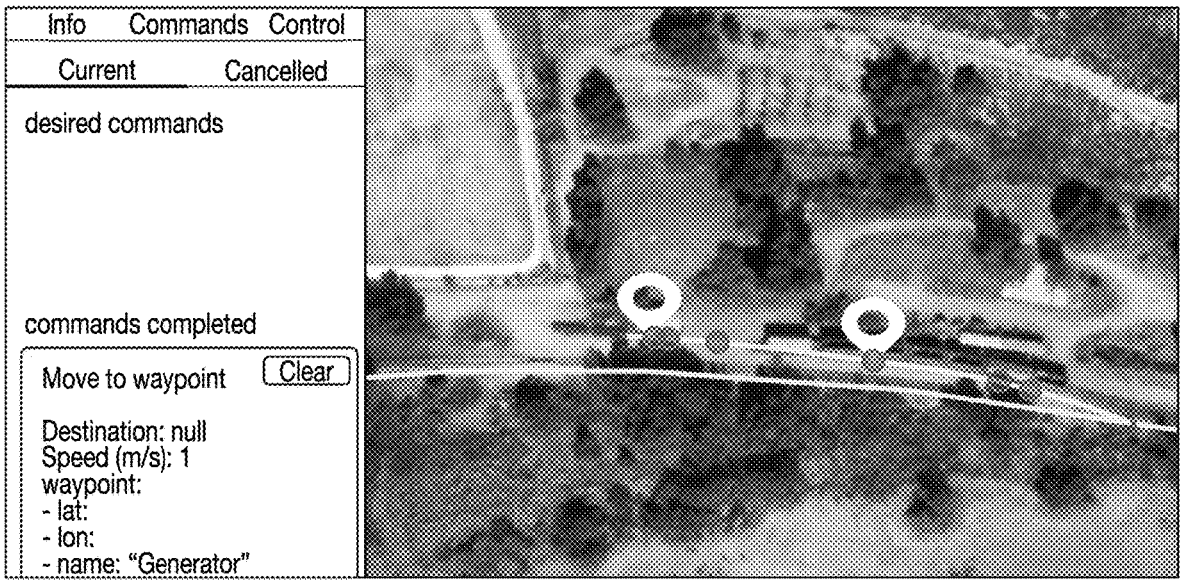

In some variants, such as in a yard operation context, user inputs received via the UI can be used to generate vehicle commands, which can be used to indirectly control a vehicle(s) in the form of waypoint commands provided to the motion planner (e.g., which may generate instructions to one or more control vehicles and/or direct operation of the system based on the waypoint commands; an example of waypoint-based command/control with a user interface is shown in FIG. 6A and FIG. 6B).

In variants, the UI may facilitate manual provisions of waypoint-based commands via selection of waypoints (e.g., automatically generated waypoints) in an overlayed satellite image, aerial image, GPS referenced map, and/or another suitable interface. For instance, the UI may facilitate waypoint selection via a web application, API, mobile device (e.g., tablet or other wireless/cellular device), and/or any other suitable device(s)/service(s). In a first example, a yard operator (e.g., in proximity to a train/vehicle) may select predetermined waypoints (e.g., associated with predefined track features; automatically generated from named/mapped track features) via a first device which is communicatively coupled (e.g., wirelessly) to the motion planner, such as via a web app and/or API. As a second example, a remote operator may select waypoints via a remote (tele-)operator platform. As a third example, users may select automatically generated waypoints for named track features based on a (semantic) track feature name (e.g., or other index/ID), allowing the user to select the (predefined) geocoordinate waypoint (e.g., without needing to directly input specific coordinates). However, the UI may otherwise facilitate selection/provision of waypoints.

The waypoints can be separately maintained in a waypoint database, managed as a part of the map data service, generated using data from an external database(s) (e.g., a satellite map of Earth; a railroad authority map; etc.), and/or can be otherwise determined. In a first variant, waypoints can be predetermined and/or automatically determined based on the locations of track features. In an illustrative example, a user can select a predefined (e.g., indexed in association with a named track feature, such as a track-adjacent warehouse or maintenance station they want a train/vehicle to stop, wherein the location of the track-adjacent warehouse or maintenance station is provided as the waypoint). Alternatively, the UI may be used to manually define waypoints (e.g., relative to an aerial image, etc.), and/or may define positions/distances relative to waypoints (or associated track features).

Waypoint selections and/or additions (e.g., by users; automatically generated waypoints from track features) may be validated to prevent addition or selection of waypoints which would fail to respect safety, regulatory, or other constraints of the rail network (e.g., around track features). For instance, waypoint selections can be constrained/limited based on regulatory restrictions (e.g., clearance distances for switches may restrict selection of waypoints behind the clearance point, as the FRA specifies that rail vehicles may not stop in this zone, etc.), user defined restrictions (e.g., a user may specify zones on the track where vehicles may not be able to stop, where waypoints within these zones are rejected to prevent the vehicle from navigating there), communication/connectivity restrictions (e.g., the system may restrict selection of waypoints within signal blackout regions or tunnels, where motion planner may lose connectivity with the vehicle an may no longer be able to issue further instructions/commands), railroad authority restrictions (e.g., the system may restrict selection of waypoints based on railroad authority grants), and/or any other suitable restrictions/constraints. In one variant, waypoints may be defined or selected in areas with established wireless signal connectivity and may, in some variants, be otherwise limited beyond of areas of known signal blackout and/or limited in regions with poor wireless signal connectivity. For example, end track coordinates may not be selected within tunnels in some implementations (i.e., where the system may prevent a user from direct a vehicle to stop a destination within a tunnel, where the vehicle may no longer be remotely managed/controlled) and/or waypoint selection may be otherwise predefined/constrained based on wireless signal availability. Additionally or alternatively, track features may exist within tunnels and/or waypoints may be selected in some tunnels (e.g., where the vehicle position may be otherwise identified/tracked, and/or where other control/communication protocols may exist), and/or any other suitable set of waypoints can be utilized.

However, the system can include or be used with any other suitable user interface and/or can exclude a user interface.

The system can include or be used with a track data system which functions to maintain track data to be used for routing, dispatch, and/or vehicle control. The track data maintained within the track data system can include: waypoint database; a track geometry (e.g., including a map of track segments, each including an 'edge' extending between a pair of 'nodes'; versioned, such as with an instance identifier and/or timestamp associated with the most recent update; etc.), track features (e.g., track geometry, clearance points, grade crossings, switch states, signal states, bulletins locations, etc.), track conditions (e.g., work zones, SR/RS zones, etc.), and/or any other suitable track data. In an example, the track geometry can be defined by a set of named track features (e.g., mileposts, fractional mileposts, control points, clearance points, signals, switches, stations, terminal locations, crane locations, charger locations, garages, destinations of interest, features/coordinates associated with track rules, etc.), each associated with a geographic location (or 'node'), with track segments defined therebetween, along a linear 'edge' or path between the nodes. The track geometry can be represented as a graph (e.g., of locations/nodes connected by track segments), a map, and/or otherwise represented. However, the track geometry can be otherwise defined. The track geometry and/or track data can be predetermined, derived from 3$^{rd}$ party data/maps (e.g., railroad maps), received from a railroad authority, and/or can be otherwise determined/updated with any suitable timing/frequency. The motion planner and the vehicle controller can both access and/or locally store track data (e.g., versioned track geometry) for use in any suitable determination/control determinations. Track data can be pushed to the motion planner and/or vehicle controller(s) and/or pulled from the track data system (e.g., by the motion planner and/or vehicle controller) with any suitable timing/frequency.

In a specific example, track data pertaining to regions proximal to the vehicle (e.g., within an authority granting region; within a 50-mile radius; a rail yard map at a current location or at a planned destination; etc.) can be pushed to the vehicle controller with any suitable timing/frequency (e.g., as a part of a warrant provision and/or as a part of command provision; separately from provision of commands or authority grants/warrants; etc.). However, the system can otherwise operate with any other suitable track data system and/or track map(s), and/or can otherwise maintain track data knowledge/information sharing throughout the system.

In variants, the waypoints (and/or waypoint database) referenced by and/or utilized in conjunction with the UI can be entirely independent of the track geometry. For example, track features and/or waypoints associated therewith can be managed in an external database or map service (e.g., tagged locations in a satellite map of Earth, for example) which can be used to generate GPS references for user-selected waypoints. Alternatively, the waypoints can be maintained locally (e.g., managed in a local database using proprietary data collected and/or stored by a server), remotely, via cloud storage/processing, generated (algorithmically) during runtime (e.g., around proximal track features), and/or can be otherwise maintained/managed.

Waypoints can be associated with track features (i.e., at least a portion of the waypoints may be associated with and/or defined relative to the Earth-relative position of a track feature), which can include: mileposts, fractional mileposts, control points, clearance points, signals, switches, stations, terminal locations, crane locations, charger locations, garage locations, destinations of interest, and/or any other suitable track features/coordinates associated with track rules. Waypoints can be defined with a GPS/GNSS coordinate position, an Earth-referenced cell (e.g., S2 cells, etc.), a geohash, and/or can be otherwise suitably defined.

In variants, waypoints can be automatically generated from (i.e., defined based on the locations of) mapped track features (e.g., from a map service, external database, or separately managed database). As an example, waypoints can be automatically generated from track features in a map, which may allow users to select waypoints relative to (pre-)mapped track features without manually entering a coordinate position for the feature. Waypoints can be automatically generated from mapped track features during runtime (e.g., pulled from a database or map service in proximity to a relevant portion of track, allowing a user to select relevant track features as waypoints), periodically, in response to a pull request, and/or with any other suitable frequency/timing. Automatically generated waypoints can be determined in locations along the track based on system rules and track constraints (i.e., where a vehicle is able to stop). For example, waypoints can be generated in proximity to track features based on track rules, regulatory constraints, and/or system limitations/constraints. A single waypoint can be automatically generated for a track feature (e.g., at a milepost or charging station) and/or multiple waypoints can be automatically generated around a track feature (e.g., on either side of a crossing; on each leg of a switch; etc.).

In a first example, waypoints can be automatically generated on the reverse, normal, and facing legs of switches (e.g., which are used as destinations to move the vehicle through the switch and as staging locations to park the vehicle before making a move through the switch; at clearance points which are offset by appropriate clearance distances/constraints on each leg, etc.).

In a second example, waypoints can be automatically generated around crossings (e.g., at clearance points offset on either side of the crossing by an appropriate clearance; allowing either side of the crossing to be selected in order to move the vehicle through the crossing and as staging locations to stop the vehicle before making a move through the crossing).

However, the system can otherwise generate and/or manage waypoints, and/or the system can include or be used with any other suitable track data system and/or map service(s).

The motion planner 130 (a.k.a., "vehicle dispatch system") functions to command and/or dispatch a set of vehicles within the rail network. Additionally or alternatively, the motion planner can function to impose vehicle collision constraints and/or authority constraints on vehicles within the rail network (e.g., on a railroad governed by the railroad authority, at a rail yard, etc.). Additionally or alternatively, the motion planner functions to determine a set of instructions which direct vehicle operation throughout the rail network. Additionally or alternatively, the motion planner can function to maintain state awareness of vehicles throughout the rail network.

The motion planner determines instructions for each of the set of vehicles and/or vehicle controllers thereof operating within the rail network. In a first example, the motion planner can determine a track reservation(s) (a.k.a., "microwarrant"; granular authority region along a section of track) for a vehicle(s) operating within the rail network, such as described in U.S. application Ser. No. 18/373,225, filed 26 Sep. 2023, which is incorporated herein in its entirety by this reference. In a second example, the motion planner can determine track reservations for vehicles such as an electric vehicle and/or bogie as described in U.S. application Ser. No. 17/694,499, filed 14 Mar. 2022, and/or U.S. application Ser. No. 17/335,732, filed 1 Jun. 2021, each of which is incorporated herein in its entirety by this reference.

The motion planner can determine and/or provide commands (a.k.a., dispatch instructions) to vehicles which include: a (granular) of track reservation (e.g., a list of track segments referenced to map, track boundary constraints, a path segment along the track geometry, etc.), a set of operational parameters (e.g., target speed, speed limit, traversal direction), an expiration parameter (e.g., duration of proceed authority), a track condition parameter (e.g., checksum, validation parameter, etc.), a heartbeat parameter, and/or any other suitable parameters/information.

The motion planner can issue (dispatch) instructions to vehicles (e.g., via wireless communication, such as an LTE connection): periodically, aperiodically, in response to a track map update (e.g., change in track condition, issued bulletin, track geometry change, state change, version update, etc.), in response to an authority grant change/update (e.g., based on and/or with any other suitable timing/frequency), in response to receipt of an updated vehicle state (e.g., from the vehicle controller), in response to a user command/update (e.g., a waypoint-based command/update), and/or with any other suitable timing/frequency. As an example, the dispatch instructions can be issued periodically (e.g., every 10 seconds, every 20 seconds, etc.) to facilitate granular state awareness and/or instruction of vehicles within the network. As a second example, the motion planner can direct vehicles as described in U.S. application Ser. No. 18/373,225, filed 26 Sep. 2023, which is incorporated herein in its entirety by this reference. However, the motion planner can provide any other suitable instructions and/or otherwise suitably command/dispatch vehicles (e.g., in accordance with Block S120).

Figure 4:
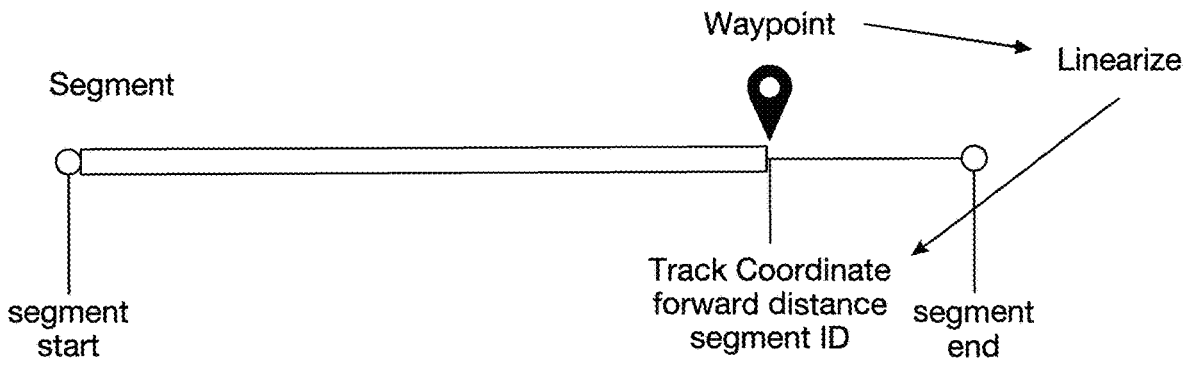
FIG. 4 is a graphical illustration of a variant of waypoint translation onto track geometry.

Dispatch instructions (a.k.a., vehicle commands) provided by the motion planner to the rail vehicle(s) can include a (granular) region of track and/or operational parameters which direct vehicle routing and/or traversal (along the region of track) within the rail network. In a first example, a navigation command can direct a vehicle in a particular direction between a starting waypoint and ending waypoint (e.g., the distance between the starting waypoint and ending waypoint can be 50 miles in the case of main line operations or a 10-meter sequence of track spanning a gate or switch in the case of yard operations, etc.), where the dispatch instructions include a region of track between the locations corresponding to the starting and ending waypoints, referenced to the versioned track geometry (e.g., segment ID and path length along the segment, for example). In a second example, a navigation command can direct a vehicle to traverse a distance down the track, where the dispatch instructions include a current location of the vehicle referenced relative to the versioned track geometry (e.g., track coordinate along a versioned track segment, an example of which is shown in FIG. 4) and a region of track spanning a distance along the versioned track geometry from the current location. In a third example, a navigation command can be a GPS navigational route, where the dispatch instructions can be a sequence of track regions referenced/indexed against the versioned track geometry. Navigation commands can be received at the motion planner from the user interface (e.g., for manually determined waypoint navigation), predetermined (e.g., for a train running a fixed schedule), received from a fleet management system, and/or otherwise determined. Commands can be assigned/directed to a particular vehicle and/or a vehicle identifier associated with a vehicle controller of the vehicle. For example, a command can be associated with a navigation and traversal of a train between an initial waypoint (and/or a corresponding track coordinate) and a destination waypoint (and/or a corresponding track coordinate). Alternatively, navigation commands can be unassigned, undirected, vehicle indiscriminate, and/or can be any other suitable commands.

In variants, the motion planner can automatically determine dispatch instructions based on: the navigation commands (e.g., received from the UI and/or a fleet management system), existing authority grants (e.g., as issued by the railroad authority), the vehicle state (e.g., received from the vehicle controller to which the micro-warrant will be granted/assigned), track features/conditions (e.g., received/retrieved track data system), and/or any other suitable information.

The motion planner can include processing and/or processing modules which can be: local, remote (e.g., at a remote server, at a third party server, cloud processing, etc.), centralized, distributed, and/or processing for the motion planner can be otherwise executed. In a specific example, motion planning can be regional and/or a set of regional motion planners can each govern vehicles within a respective track region. In variants, the motion planner and the set of vehicles (and/or vehicle controllers thereof) within the network preferably operate contemporaneously and/or synchronously, where the motion planner can issue dispatch instructions asynchronously to individual vehicles of the set (e.g., facilitating asynchronous state management of the vehicles within the network).

However, the system can include any other suitable motion planner.

The vehicle controller functions to control a vehicle within the rail network to facilitate operation of the vehicle based on the (waypoint based) vehicle commands and/or dispatch instructions derived therefrom. More preferably, the vehicle controller functions to facilitate autonomous operation of the vehicle within the track region using the versioned track geometry (e.g., for a dispatch instruction derived from the command waypoints). As an example, the vehicle controller may retain agency to stop within the track region based on perceived surroundings or internal diagnostics, but the movement/control of the vehicle controller may be directed and/or limited by the dispatch instructions (e.g., and/or static/dynamic constraints associated therewith; such as an authority region, speed constraints, logic gates, etc.). For example, the dispatch instructions may constrain: maximum speed, maximum proceed distance (e.g., movement boundaries), autonomy level (e.g., full autonomy, partial autonomy, human-in-the-loop control, etc.), direction of operation (e.g., unidirectional operation, bidirectional operation, etc.), proceed capability through a track feature (e.g., manual validation/verification may be required to advance through a switch of unknown state, for example) and/or can otherwise constrain vehicle operation. In a second example, the dispatch system can determine a sequence of dispatch instructions based on the waypoint commands, which can be sequentially provided to (and executed sequentially by) the vehicle controller, while respecting vehicle autonomy and/or practical track constraints (e.g., motion gated/limited by a switch state, for example).

Additionally, prior to executing the dispatch instructions, the vehicle controller can validate dispatch instructions (such as the track geometry or track features pertaining to the dispatch instruction), such as by way of a checksum or other validation protocol (e.g., hash function, etc.). For example, dispatch instruction and/or track-geometry-referenced coordinates thereof can be validated using a version identifier for the track map (e.g., stored locally at the vehicle in association with current track geometry version and/or received in association with a command; prior to executing the dispatch instruction).

In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

The vehicle controller preferably determines a vehicle state (a.k.a., vehicle status) and communicates the vehicle state to the vehicle dispatching system (e.g., which can be used for validation, verification, and/or subsequent micro-warrant determination). The vehicle state determined by the vehicle controller can include: speed estimation, battery characteristics (e.g., state of charge, state of health, state of power, etc.), heading, diagnostic parameters (e.g., battery characteristics, powertrain characteristics, sensor characteristics, etc.), perception performance (e.g., heading distance, etc.), brake performance estimates (e.g., max stopping distance), environmental representations (e.g., classification of objects/obstacles in the environment), and/or any other suitable vehicle state parameters/estimates. Additionally, the vehicle controller can provide loop closure communicating (to the vehicle dispatch system) confirmation of version updated to the track geometry (e.g., via a checksum, hash function, etc.; otherwise providing loop closure for map version updates), heartbeat parameters (e.g., central system connection parameters, warrant update parameters, etc.), and/or any other suitable information.

Additionally or alternatively, the vehicle controller can function to distribute power and/or communications onboard the vehicle to affect vehicle control based on the dispatch instructions. The vehicle controller can additionally or alternatively function to implement autonomous navigation commands, teleoperation commands (e.g., received from a remote teleoperator), autonomous vehicle control (e.g., based on the set of operational parameters), and/or any other vehicle control based on the dispatch instructions. The controller is preferably onboard the vehicle (e.g., mounted to a vehicle chassis, etc.), but can alternatively be remote from the vehicle. The controller can be centralized (e.g., packaged within a single module) or distributed (e.g., across multiple compute nodes, packaged within multiple compute modules, etc.). The controller can receive sensory inputs/measurements from the sensor suite, which can be used to determine a vehicle state, dynamically control the vehicle, manage the batteries, and/or control the electric powertrain. The controller can include a battery management system which functions to monitor the state of the battery. The state of the battery can include: state of charge (SoC), state of health (SoH), state of power (SoP), state of safety (SoS), temperature (e.g., of the battery or a set of cells therein, of a working fluid, a temperature distribution of battery cells, etc.), and/or any other suitable characteristics. The battery management system can also function to control the charge and/or discharge of the battery. However, the controller can include any other suitable BMS. The controller can include one or more motor controllers which function to condition power from the battery to be supplied to a motor and/or to control electrical propulsion and/or dynamic (regenerative) braking at the motor. There can be a single motor controller associated with the vehicle, one motor controller per motor, and/or any other suitable number of motor controllers. However, the controller can include any other suitable motor controllers. In variants, the controller can function to facilitate vehicle transit and/or powertrain control as described in U.S. application Ser. No. 17/335,732, filed 1 Jun. 2021, which is incorporated herein in its entirety by this reference. In variants, the controller can control a platoon of electric vehicle(s) individually or may be used to control vehicles in a pairwise manner (e.g., via V2V communications, etc.).

In variants, a vehicle controller can include: a speed controller, velocity controller, PID controller, MPC controller, nonlinear controller, feedback controller, feedforward controller, and/or can implement any other suitable control schemes or any combination/permutation thereof.

In variants, the vehicle controller may use GPS feedback, track-relative odometry (e.g., based on wheel velocity estimation, inertial data, etc.), and/or other localization techniques to facilitate execution of dispatch instructions and/or vehicle commands. Additionally, the vehicle controller may provide feedback (to the motion planner) in Earth coordinates (e.g., publishing a GPS position estimate of the vehicle) and/or track coordinates (e.g., distance along an indexed track segment) to facilitate motion planning.

However, the system can include any other suitable vehicle controller and/or operate in conjunction with any other suitable vehicle(s) or vehicle control scheme(s).

The system can optionally include or be used with a fleet management system which functions to command and/or direct fleet resources (e.g., vehicles, cargo, etc.) throughout the vehicle network. Additionally or alternatively, the fleet management system can facilitate track authority requests/grants from a railroad authority (e.g., or a railroad authority integration service; assignment of individual vehicles to a command/request from a user). Additionally or alternatively, the fleet management system can determine vehicle commands based on user inputs/requests via the user interface, such as in accordance with Block S110. Additionally or alternatively, the fleet management system can function to update the track map data and/or track conditions based on vehicle state information (e.g., received from a vehicle controller), information received via the user interface (e.g., manual switch state determinations, operator requests/commands, manual feedback, manual validations, other manual inputs, etc.), and/or information from secondary/external sources (e.g., information received from a railroad authority, such as may be received via a railroad integration service; which may include track features, track conditions, switch state, etc.).

In some variants, the fleet management system can determine a vehicle to dispatch for a particular vehicle command, such as according to a set of rules, heuristics, decision logic (e.g., a decision tree, etc.), a neural network (e.g., weighted linear regression), and/or can otherwise select a vehicle for dispatch. For example, vehicles can be selected based on availability (e.g., not loaded with cargo), proximity to a target (e.g., distance, traversal time, number of intervening vehicles, etc.), vehicle state, state of charge, state of maintenance, and/or can be otherwise selected. Additionally or alternatively, commands can be manually associated with a particular vehicle (e.g., via UI inputs; where a user directs a particular vehicle to move to a particular location via the UI, for example) or can otherwise be determined upstream of the vehicle dispatch system. Alternatively, commands can be otherwise associated with a particular vehicle and/or not associated with a specific vehicle.

In some variants, the fleet management system can additionally or alternatively be used to determine (waypoint-based) vehicle commands based on routing and/or navigational optimizations (e.g., based on the track map, existing authority grants and/or warrants associated therewith, etc.) for the fleet of vehicles within the rail network, and communicate the vehicle commands to the dispatch system for separate dispatch and control of the various vehicle instances.

However, the system can include or be used with any other fleet management system and/or can exclude a fleet management system.

However, the system can include any other suitable components.

4. Method

Figure 2:
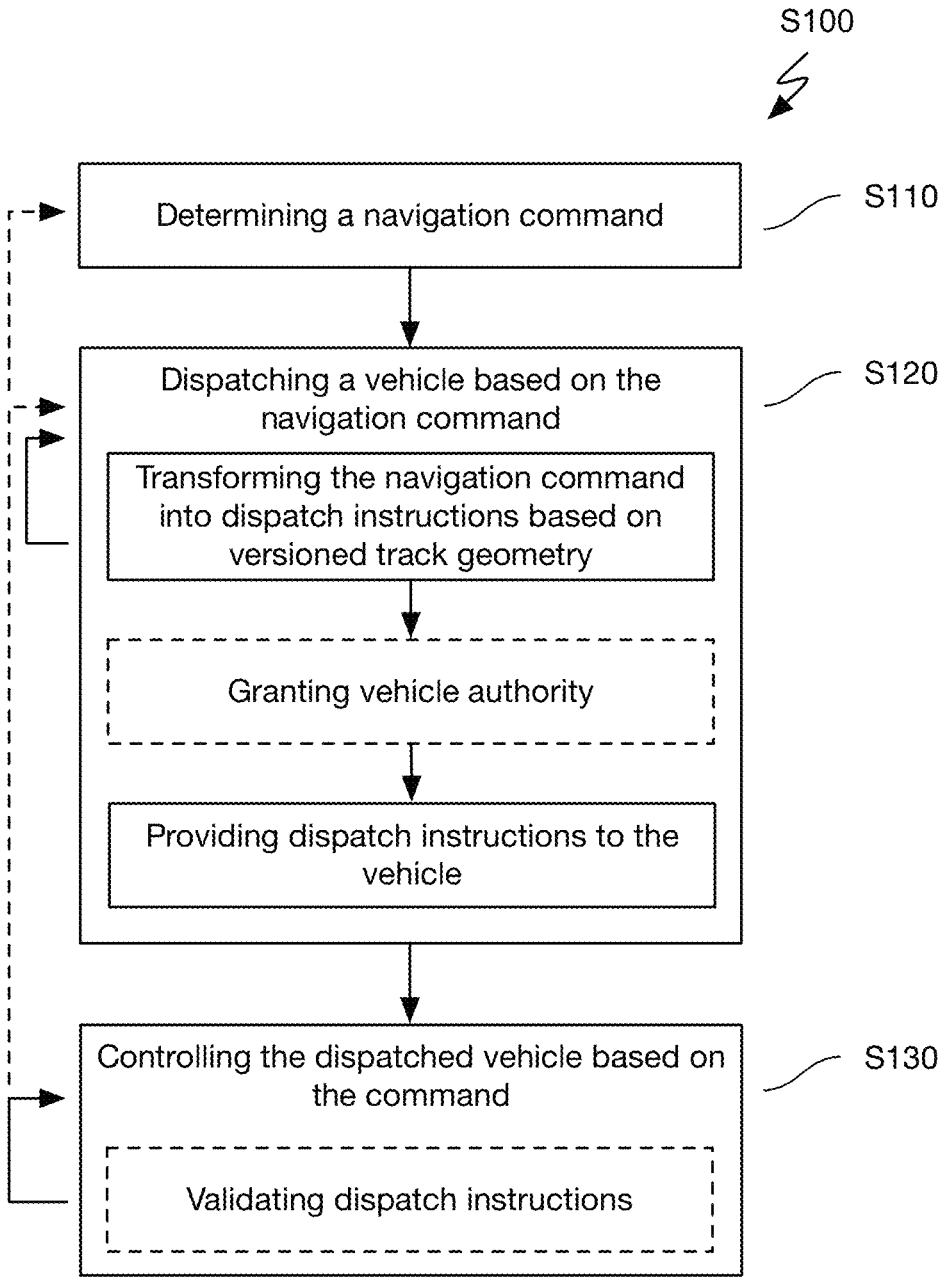
FIG. 2 is a flowchart diagrammatic representation of a variant of the method.

The method S100, an example of which is shown in FIG. 2, can include: determining a navigation command Silo; dispatching a vehicle based on the navigation command S120; and controlling the dispatched vehicle based on the command S130. The method functions to facilitate waypoint-based operation of rail vehicles within a rail network.

Determining a navigation command S110 function to direct vehicle dispatch and/or vehicle navigation within the rail network. More preferably, navigation commands/instructions are preferably determined in a format which is independent of a current map version and/or current track geometry (i.e., waypoints), which may facilitate control based on the commands (e.g., even in cases where the track geometry changes or the map version is updated after navigation commands are determined in S110).

The navigation commands are preferably waypoint-based commands (or waypoint-based instructions) determined in a global coordinate frame (e.g., Earth referenced coordinates; GPS coordinates; S2 cell; geohash; etc.). The navigation commands can be determined by the user interface (e.g., in the case of manual vehicle requests; in a tele-operation context), a fleet dispatch system, and/or any other suitable systems or processing modules/endpoints.

Navigation commands can be determined manually (e.g., by a user and/or based on a user input; via the user interface), automatically (e.g., with a fleet management system), locally (e.g., at a rail-yard by a local operator), remotely (e.g., at a remote tele-operation facility based on remote data collection, such as onboard perception and/or location data from a vehicle; etc.), and/or can be otherwise determined.

Navigation commands are preferably pushed from the UI (e.g., determined at the behest of a user/operator and/or based on fleet level optimizations), but can additionally or alternatively be determined in response to vehicle intervention requests (e.g., requesting remote assistance, intervention, operation; based on a request from a vehicle or dispatch system), based on a periodic update request, and/or with any other suitable frequency/timing.

Additionally or alternatively, the motion planner can automatically determine commands (e.g., for recurrent, automated operation).

As a first example, navigation commands can be determined at the user interface by user selection of waypoints (e.g., in an overlayed satellite image or GPS referenced map) which are GPS referenced. The waypoints can be select from a waypoint database and/or can be generated using an external database or map data service (e.g., a satellite map of Earth; a railroad authority map; etc.). In an illustrative example, a user can select which track-adjacent warehouse or maintenance station they want a train to stop at (or a waypoint generated based on the track feature location), wherein the location of the track-adjacent warehouse or maintenance station is used as the waypoint.

In variants, determining navigation commands S110 can optionally include a set of operational parameters (e.g., target speed, speed limit, traversal direction), or may otherwise exclude operational parameters altogether (e.g., where operational parameters can be separately derived from track map data, such as advisories and bulletins, during subsequent method steps; where operational parameters may not be unutilized; etc.).

However, the navigation command(s) can be otherwise determined.

Dispatching a vehicle based on the navigation command S120 functions to dispatch a vehicle to facilitate execution of the navigation command. S120 can include: transforming the vehicle command into dispatch instructions (a.k.a., a vehicle command) based on versioned track geometry; optionally granting vehicle authority; and providing dispatch instructions (e.g., in the form of a vehicle command) to the vehicle.

Transforming the navigation command into dispatch instructions (a.k.a., vehicle command) based on versioned track geometry functions to translate the waypoint-based vehicle command into track-geometry-referenced instructions which are referenced against an (updated) version of the track geometry (e.g., which is commonly available to the motion planner and the vehicle controller, allowing for track-geometry-referenced navigation and control based on the instructions in subsequent portions of the method). For example, track feature locations along the versioned track geometry can be defined by "track coordinates" which are specific to a track geometry version, and referenced with a segment identifier and a forward distance (e.g., which can be held accurate to a millimeter, centimeter, etc.). The forward distance of a segment can be defined by the estimated distance (e.g., linear; path length along a polynomial path; etc.) from the start point of a segment to any other location on the segment. Additionally or alternatively, track coordinates can be indexed, interpolated (e.g., linearly between nodes; as a fraction of the segment), and/or can be otherwise defined.

Figure 5:
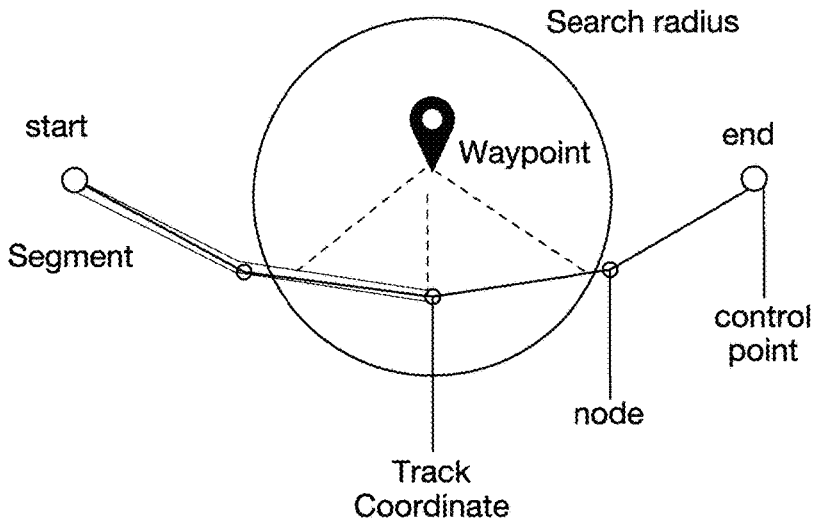
FIG. 5 is a graphical illustration of a variant of waypoint translation onto track geometry.

In some variants, the vehicle command can be transformed into track geometry by 'linearizing' the waypoint (e.g., in the form of a 2D+ GPS coordinate point for a geographic location) into a track-referenced geometry; which may be thought of as a set of paths (e.g., 1 dimensional; where all points along the path may be referenced as a distance along the path/segment; an example is shown in FIG. 4). The linearization algorithm can take a GPS coordinate (e.g., waypoint) as an input and determine the nearest track feature location within some search radius (e.g., an example is shown in FIG. 5; the search radius can be: 10 cm radius, 50 cm radius, 1 meter radius, 1.5 meter radius, 3 meter radius, 5 meter radius, any open or closed range bounded by the aforementioned values, selected/adjusted based on the context and/or sensitivity to precision/accuracy, etc.). If the track cannot be found within the "search radius" of the GPS coordinate, the linearization algorithm can return an error (e.g., which can be provided as feedback to the UI; allowing a user/operator to update the waypoints, for example). If multiple pieces of track are identified within the search radius they can be returned as a list (e.g., ordered from closest to farthest) and/or a selected track segment can be returned (e.g., closest segment can be returned) for use in control according to S130.

Additionally or alternatively, waypoints can be transformed into dispatch instructions associated with versioned track geometry by a non-linear mapping, searching/sorting algorithms, classifiers (e.g., neural network based, GBMs, etc.), decision trees, heuristic and/or scoring-based approaches (e.g., heuristic searching algorithm), and/or any other suitable transformations or classification techniques. However, the vehicle command can be otherwise suitably transformed into dispatch instructions which are referenced against the (updated) track geometry version.

In a first variant, the transformation of the (waypoint-based) commands into track-geometry-referenced can be performed entirely at the motion planner, such as where the vehicle can validate the track geometry version prior to executing dispatch instructions. In a second variant, the vehicle commands may be transformed into track-geometry-referenced commands by both the vehicle controller and the motion planner (e.g., where the dispatching system may grant authority to the vehicle and relay the waypoint-based command to the vehicle, with both responsible for transforming the waypoints into track geometry based on the current version; an example is shown in FIG. 3).

In some variants, S120 can optionally include determining a route (e.g., a simple route; a complex route; etc.) which connects the track-geometry-referenced coordinates with the (current versioned) geometry of the track along a single path (e.g., in cases where commands are associated with multiple sections of track). For example, in cases where waypoints lie on separate segments of the map (e.g., with intervening nodes, control points, etc.), S120 can include determining a route as a sequence of segments (e.g., indexed edges and/or nodes) which connect the track-geometry-referenced coordinates associated with the command(s). In some variants, routes may be entirely executed for a single state of each control point (e.g., crossing, switch, etc.) along the route. Alternatively, complex routes may cross a control point repeatedly and/or may require a change in state/status of the control point in order to be traversed (e.g., where the vehicle dispatch system may not grant authority for a portion/segment of the route until a change in state of a control point occurs).

Routes can be determined from for the versioned map geometry for track-geometry-referenced coordinates according to any suitable pathfinding (or pathing) algorithm for the graph (e.g., weighted based on distance, time, number of control points, number of switch state changes, etc.), such as using a hierarchical pathfinding approach. It is understood that numerous pathfinding approaches/algorithms for a particular map/graph which can be interchangeably used in variants of the system and/or method.

However, S120 can include any other suitable route determination(s) and/or may alternatively not determine a route (e.g., in cases where commands may be executed along a single segment of the current track map).

In some variants, S120 can optionally include granting authority (to a vehicle) and/or providing an (exclusive) track reservation to facilitate execution of the navigational command and/or the dispatch instructions associated therewith. The motion planner may determine a new track reservation or update an existing reservation for the vehicle which grants the vehicle proceed authority to execute the dispatch instructions and/or operate within the region of track associated with the dispatch instructions. The motion planner can provide track reservation and/or update track reservation for the vehicle based on the dispatch instructions: once, repeatedly, periodically, and/or with any other suitable frequency/timing. As an example, the motion planner can impose rules on new/updated authority grants and/or reservations, such as a requirement that only one reservation exists for each region of track, to impose collision constraints and/or reduce operational risk factors. As a second example, nonexclusive with the first, the motion planner can repeatedly issue warrants to facilitate operation as described in U.S. application Ser. No. 17/732,143, filed 28 Apr. 2022, which is incorporated herein in its entirety by this reference. As a third example, the motion planner can provide track reservations and/or warrants (e.g., micro-warrants and/or macro-warrants) as described in U.S. application Ser. No. 18/373,225, filed 26 Sep. 2023, which is incorporated herein in its entirety by this reference. However, the dispatching system can otherwise determine, assign, and/or update warrants in conjunction with S120, and/or can otherwise grant authority to vehicles operating within the rail network. Alternatively, the system and/or method can operate without new authority grants or modification to existing authority grants in S120 (e.g., where a vehicle may have full autonomy and authority to operate within a secure region of track, for example).

In variants, vehicle commands, track reservations, and/or authority grants can be based on: track coordinates (e.g., relative to a map version; received from the vehicle), track information/conditions (e.g., control point status, a switch state associated with the warrant, etc.), a route (e.g., control point dependencies thereof), and/or any other suitable data/information. For example, authority grants can be issued for a route (e.g., connecting track coordinates on the versioned map) or a portion thereof (e.g., sub-route with single set of required switch states, a predetermined track distance along the route, a dynamically determined distance along the route, etc.). S120 can include providing dispatch instruction to the vehicle. The provided dispatch instructions can include: the (waypoint-based) navigation command or a sub-portion thereof, track geometry referenced move-to-location commands (e.g., transformed from waypoint-based move-to-location commands), a warrant (e.g., new, updated, etc.; an authority grant), a version parameter associated with the track geometry version (e.g., checksum; timestamp of most recent update; etc.), and/or any other suitable parameters. Additionally, dispatch instructions can include track data (e.g., from the track database, such as track features, track conditions, and/or any other suitable track data) and/or the vehicle can separately retrieve/access this data to facilitate execution in accordance with Block S130.

Dispatch instructions can be provided to the vehicle: once, repeatedly, periodically, immediately in response to dispatch instruction generation (or authority grant provision), after completion of a prior dispatch instruction and after authority confirmation for the next dispatch instruction (and/or after confirmation that a control point state matches the required state for the route), and/or with any other suitable timing. As an example, dispatch instructions to facilitate execution of a complex command (e.g., having multiple sub-commands, having a plurality of waypoints; requiring a switch state change to facilitate execution; an example is shown in FIG. 7) can be determined and provided to the vehicle: once, iteratively (e.g., upon a receipt of confirmation that a sub-command has been completed or an intermediate waypoint has been reached), repeatedly, in response to receipt of a map version update, and/or with any other suitable timing/frequency.

In variants, the dispatch instructions can include a target trajectory in track coordinates (e.g., timeseries of linearized track coordinates; where the vehicle controller aims to track the target trajectory).

However, vehicles can be otherwise suitably dispatched and/or dispatch instructions can be otherwise determined/provided by the dispatching system.

Controlling the dispatched vehicle functions S130 to facilitate execution of the command. As an example, the dispatched vehicle can be controlled based on dispatch instructions as described in U.S. application Ser. No. 17/732,143, filed 28 Apr. 2022, and/or U.S. application Ser. No. 18/373,225, filed 26 Sep. 2023, each of which is incorporated herein in its entirety by this reference. As a second example, the vehicle controller can autonomously execute the commands and/or dispatch instructions based on information received from the dispatch system and/or the track data system.

In variants, S130 can optionally include validating the dispatch instructions, which functions to verify/validate that the dispatch instructions and/or vehicle navigation/control are based on the current, most up-to-date version of the track geometry. The dispatch instructions are preferably validated based on a version parameter associated with the track map, such as by performing a checksum and/or other validation/verification measure. As an example, if the track geometry is updated between dispatch instruction generation in accordance with Block S120 and execution in S130 (and/or if the vehicle controller and the dispatch system are accessing different versions of the track map), the vehicle can invalidate the dispatch instructions (e.g., which may lead to the vehicle remaining in place, continuing to operate based on a prior set of instructions, entering a holding pattern, awaiting updated instructions and/or an updated map version, etc.). However, the dispatch instructions can be otherwise suitably validated prior to execution of the dispatch instructions and/or commands.

However, commands can be otherwise executed and/or vehicles can be otherwise suitably controlled within the rail network.

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A method for waypoint-based rail navigation comprising:

determining a waypoint-based command comprising a set of instructions associated with traversal to a destination, the destination comprising a GPS location of a predetermined feature of a rail network selected, at a user interface, from an aerial image overlay of the rail network;

determining an updated track geometry version comprising a version identifier and a set of nodes and edges, each node indexed in association with a GPS location, each edge extending between a pair of nodes;

storing the updated track geometry version at a memory onboard the rail vehicle;

at a centralized motion planner, commanding the rail vehicle in track-geometry-referenced coordinates, comprising:

transforming the destination into a track-geometry-referenced position comprising a linearized distance along an indexed track edge of the track geometry; and autonomously controlling the rail vehicle based on the track-geometry-referenced coordinates, comprising:

at the rail vehicle, validating that the track-geometry-referenced coordinates are associated with the version identifier of the updated track geometry version; and controlling the vehicle on based on the track-geometry-referenced position.

2. The method of claim 1, wherein transforming the destination into a set of track-geometry-referenced coordinates uses a heuristic search algorithm.

3. The method of claim 1, wherein the waypoint-based commands and the predetermined feature are independent of the map version.

4. The method of claim 1, wherein the waypoint-based command is determined before the track geometry version update.

5. The method of claim 1, wherein the GPS location of the predetermined feature is determined prior to determining the updated track geometry version.

6. The method of claim 1, wherein the rail vehicle is commanded according to a timeseries of track-geometry-referenced coordinates.

7. The method of claim 1, wherein validating the association with the version identifier comprises a checksum validation or a hash validation.

8. A method for waypoint-based rail navigation comprising:

determining a track geometry for a region of a rail network;

determining a set of waypoint-based commands in an Earth coordinate frame, wherein the set of waypoint-based commands are independent of the track geometry, wherein the set of waypoint-based commands are associated with navigation to a destination; and controlling the rail vehicle according to the set of waypoint-based commands, comprising:

transforming the destination into a track-geometry-referenced position comprising a linearized distance along an indexed track edge of the track geometry.

9. The method of claim 8, wherein transforming the destination into a track-geometry-referenced position comprises performing a search, within a predetermined radius, for a nearest track segment.

10. The method of claim 9, further comprising: based on the search, requesting user intervention, via a user interface (UI), in response to a lack of track segments within the predetermined radius.

11. The method of claim 8, wherein the set of waypoint-based commands are associated with locations of a set of predetermined track features in the Earth coordinate frame.

12. The method of claim 11, wherein the set of predetermined track features comprises: a switch, a crossing, and a signal.

13. The method of claim 8, wherein controlling the rail vehicle comprises: with an autonomous controller onboard the vehicle, controlling the rail vehicle based on a timeseries of track-geometry-referenced positions.

14. A method for waypoint-based rail navigation comprising:

determining a track geometry comprising a set of indexed track nodes and indexed track edges, the track geometry associated with a version identifier, each indexed track node and track edge defined in an Earth coordinate frame;

determining a waypoint in the Earth coordinate frame;

transforming the waypoint into a track coordinate comprising a linearized distance along an indexed track edge of the track geometry; and autonomously controlling a rail vehicle based on the track coordinate and the version identifier.

15. The method of claim 14, wherein the waypoint is determined independently of the track geometry.

16. The method of claim 14, wherein the rail vehicle is autonomously controlled according to a timeseries of track coordinates.

17. The method of claim 14, wherein the waypoint is determined by a manual selection from an image overlay of the track geometry.

18. The method of claim 14, wherein the waypoint is selected from a predetermined array of indexed track features in an Earth coordinate frame.

19. The method of claim 14, further comprising, at a centralized planner: granting proceed authorization to the rail vehicle based on the track geometry; and maintaining a motion plan for the rail vehicle based on the waypoint in the Earth coordinate frame.

20. The method of claim 19, wherein the proceed authorization is based on the version identifier.

* * * * *